US008379881B2

(12) United States Patent
Wu et al.

(10) Patent No.: US 8,379,881 B2
(45) Date of Patent: Feb. 19, 2013

(54) SILICON BASED CAPACITIVE MICROPHONE

(75) Inventors: Zhi-Jiang Wu, Shenzhen (CN); Yong-Ze Su, Shenzhen (CN)

(73) Assignees: AAC Acoustic Technologies (Shenzhen) Co. Ltd., Shenzhen (CN); American Audio Components Inc., La Verne, CA (US)

( * ) Notice: Subject to any disclaimer, the term of this patent is extended or adjusted under 35 U.S.C. 154(b) by 687 days.

(21) Appl. No.: 12/626,835

(22) Filed: Nov. 27, 2009

(65) Prior Publication Data

US 2010/0290644 A1 Nov. 18, 2010

(30) Foreign Application Priority Data

May 15, 2009 (CN) ..... 2009 2 0131471 U

(51) Int. Cl.
*H04R 3/00* (2006.01)

(52) U.S. Cl. ..... 381/111; 381/174; 381/175; 381/176

(58) Field of Classification Search ..... 381/174, 381/175, 111
See application file for complete search history.

(56) References Cited

U.S. PATENT DOCUMENTS

| | | | | |
|---|---|---|---|---|
| 3,728,642 | A * | 4/1973 | Campman | 332/135 |
| 4,607,383 | A * | 8/1986 | Ingalls | 381/113 |
| 6,467,138 | B1 * | 10/2002 | Aime | 29/25.35 |
| 7,263,194 | B2 * | 8/2007 | Niederdrank et al. | 381/324 |
| 7,362,873 | B2 * | 4/2008 | Pedersen | 381/175 |
| 2002/0102004 | A1 * | 8/2002 | Minervini | 381/175 |
| 2002/0154790 | A1 * | 10/2002 | Steeman et al. | 381/369 |
| 2003/0099368 | A1 * | 5/2003 | Chiang et al. | 381/175 |
| 2005/0018864 | A1 * | 1/2005 | Minervini | 381/175 |
| 2005/0185812 | A1 * | 8/2005 | Minervini | 381/355 |
| 2006/0115102 | A1 * | 6/2006 | Mullenborn et al. | 381/174 |
| 2007/0222006 | A1 * | 9/2007 | Weber et al. | 257/414 |
| 2007/0242847 | A1 * | 10/2007 | Gorelik et al. | 381/355 |
| 2008/0283988 | A1 * | 11/2008 | Huang et al. | 257/680 |
| 2008/0315333 | A1 * | 12/2008 | Combi et al. | 257/415 |
| 2009/0001553 | A1 * | 1/2009 | Pahl et al. | 257/704 |
| 2009/0116669 | A1 * | 5/2009 | Song | 381/174 |
| 2010/0142744 | A1 * | 6/2010 | Rombach et al. | 381/355 |

* cited by examiner

*Primary Examiner* — Curtis Kuntz
*Assistant Examiner* — Thomas Maung

(57) ABSTRACT

A silicon based capacitive microphone includes a first printed circuit board, a second printed circuit board far away from the first printed circuit board, a transducer electrically mounted on the first printed circuit board, a controlling chip electrically mounted on the second printed circuit board, a connecting member located between the first and second printed circuit boards.

8 Claims, 2 Drawing Sheets

SILICON BASED CAPACITIVE MICROPHONE

FIELD OF THE INVENTION

The present invention generally relates to the art of microphones and, more particularly, to a silicon based capacitive microphone.

DESCRIPTION OF RELATED ART

Silicon based capacitive transducers, such as MEMS (Micro-Electro-Mechanical-Systems) microphones, are well known in the art. Silicon condenser microphones are widely used in mobile phones to receive and convert sound waves into electrical signals.

Typically, such a capacitive microphone generally includes a MEMS die having a silicon substrate, a backplate arranged on the substrate, and a moveable diaphragm separated from the backplate for forming a capacitor. While external sound waves reach the diaphragm, the diaphragm will be activated to vibrate relative to the backplate, which changes the distance between the diaphragm and the backplate and changes the capacitance value. As a result, the sound waves are converted into electrical signals.

Such typical microphones are disclosed in U.S. Pat. No. 7,166,910 B2, U.S. Pat. No. 7,242,089 B2, and U.S. Pat. No. 7,023,066 B2.

SUMMARY OF THE INVENTION

In one embodiment of the present invention, a silicon based capacitive microphone includes a first printed circuit board, a second printed circuit board far away from the first printed circuit board, a transducer electrically mounted on the first printed circuit board, a controlling chip electrically mounted on the second printed circuit board, a connecting member located between the first and second printed circuit boards.

Other features and advantages of the present invention will become more apparent to those skilled in the art upon examination of the following drawings and detailed description of exemplary embodiments.

DETAILED DESCRIPTION OF THE PREFERRED EMBODIMENT

Reference will now be made to describe the exemplary embodiments of the present invention in detail.

Figure 1:
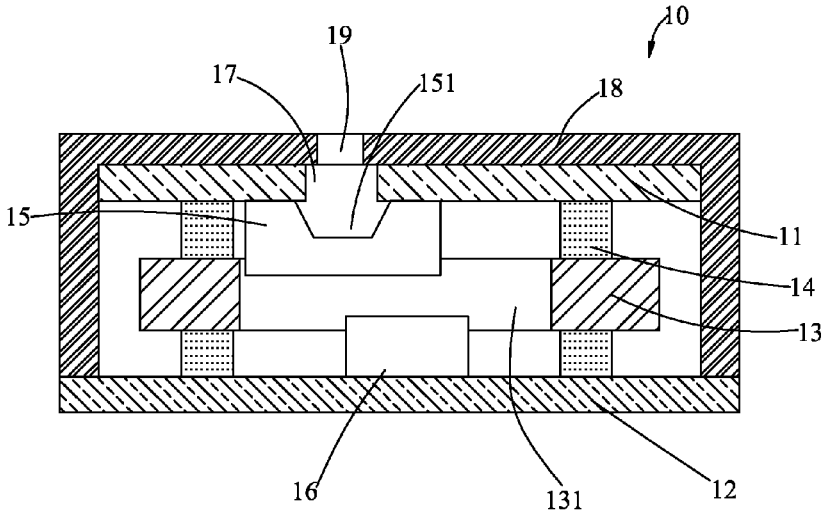
FIG. 1 is a cross-sectional view of a silicon based capacitive microphone in accordance with a first embodiment of the present invention.
Figure 2:
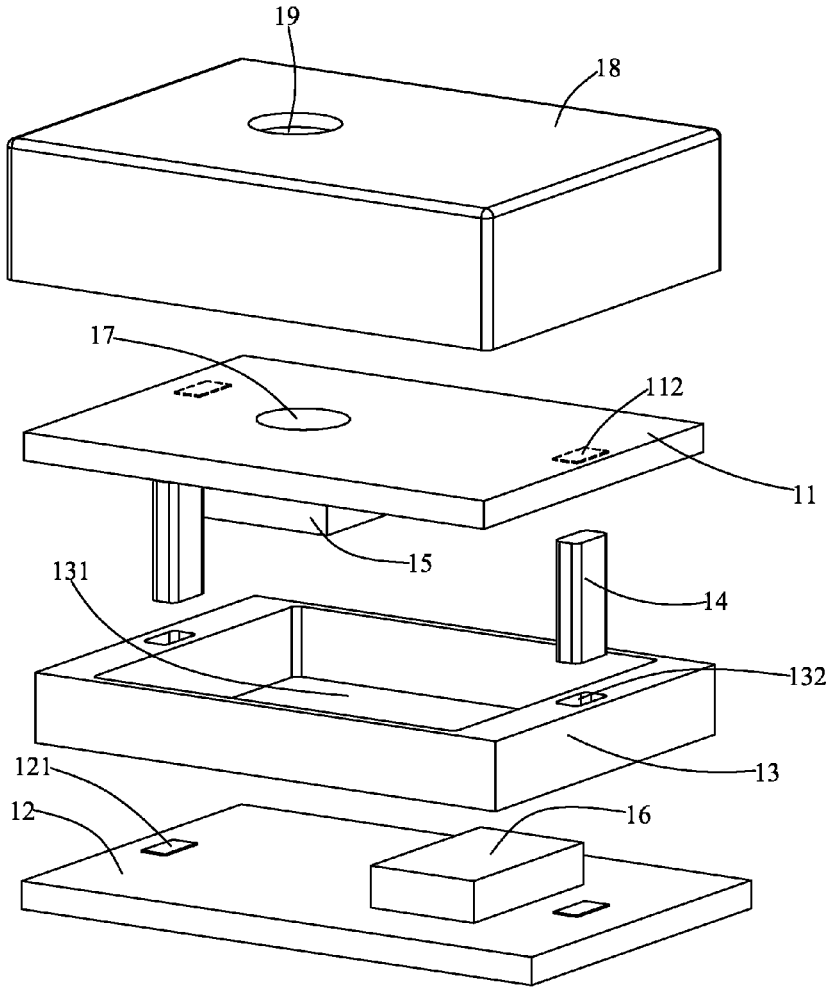
FIG. 2 is an exploded view of the silicon based capacitive microphone in FIG. 1.

Referring to FIGS. 1 and 2, a silicon based capacitive microphone 10 in accordance with a first embodiment of the present invention is disclosed. The microphone 10 includes a first printed circuit board (PCB) 11, a second printed circuit board (PCB) 12 far away from the first PCB 11, a MEMS (Micro-Electro-Mechanical-Systems) transducer 15 electrically mounted on the first PCB 11, a controlling chip 16 electrically mounted on the second PCB 12, and a housing 18 forming a case together with the second PCB 12. The housing defines a first aperture 19 for receiving external sound waves and the first PCB 11 defines a second aperture 17 aligned with the first aperture 19. The MEMS transducer 15 covers the second aperture 17 and defines a back volume 151 communicating with the second aperture 17. The microphone 10 further includes a connecting member for electrically connecting the MEMS transducer 15 to the controlling chip 16. As the first PCB 11 is far away from the second PCB 12, a space is formed between the first and second PCBs. The connecting member is located in the space and between the first and second PCBS.

The connecting member includes a supporting body 13 and a plurality of connecting poles 14 assembled with the supporting body 13. The supporting body 13 defines a plurality of through holes 132, and the connecting poles 14 pass through the through holes 132, with one end connected to a plurality of first conductive areas 112 on the first PCB 11 and the end connected to a plurality of second conductive areas 121 on the second PCB 12. By virtue of the connecting member, the MEMS transducer 15 is electrically connected to the controlling chip 16. In order to reduce the height of the microphone 10, the supporting body 13 defines an opening 131 for partially receiving the MEMS transducer 15 and the controlling chip 16.

The microphone 10 of the first embodiment has an enlarged back chamber, which obviously improves the Signal-Noise-Rate.

Figure 3:
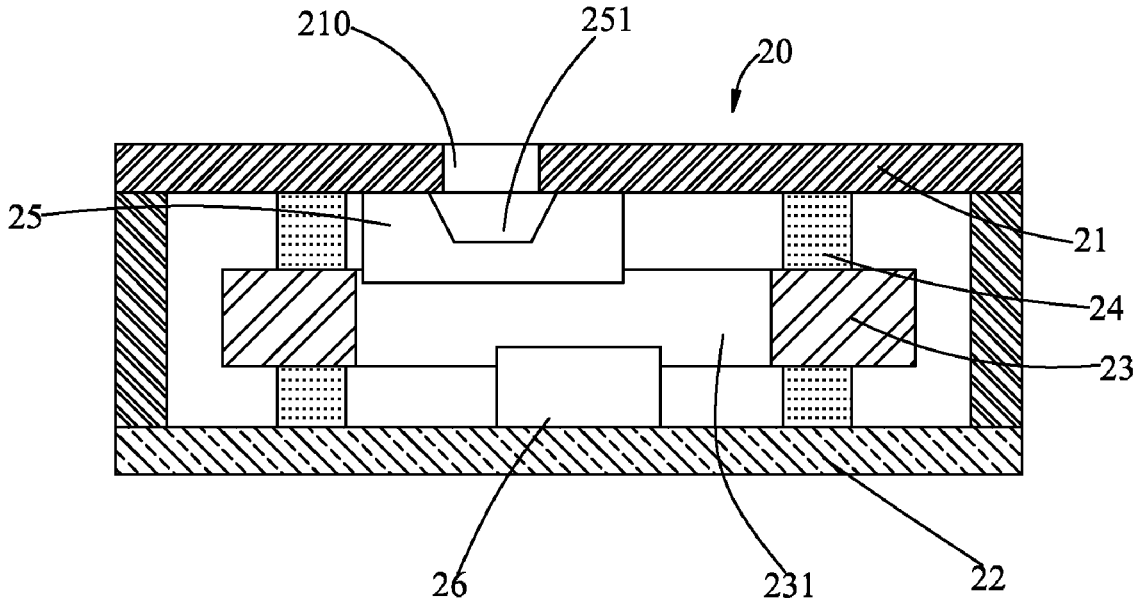
FIG. 3 is a cross-sectional view of a silicon based capacitive microphone in accordance with a second embodiment of the present invention.

Referring to FIG. 3, a silicon based capacitive microphone 20 in accordance with the second embodiment of the present invention is disclosed. The microphone 20 includes a first PCB 21, a second PCB 22 far away from the first PCB 11, a MEMS transducer 25 electrically mounted on the first PCB 21, and a controlling chip 26 electrically mounted on the second PCB 22. The first PCB 21 defines a sound aperture 210. The MEMS transducer 25 covers the sound aperture 210 and defines a back volume 251 communicating with the sound aperture 210. The microphone 20 further includes a connecting member for electrically connecting the MEMS transducer 25 to the controlling chip 26. As the first PCB 21 is far away from the second PCB 22, a space is formed between the first and second PCBs. The connecting member is located in the space and between the first and second PCBs. The connecting member includes a supporting body 23 and a plurality of connecting poles 24 assembled with the supporting body 23. By virtue of the connecting member, the MEMS transducer 25 is electrically connected to the controlling chip 26. In order to reduce the height of the microphone 20, the supporting body 23 defines an opening 231 for partially receiving the MEMS transducer 25 and the controlling chip 26.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A silicon based capacitive microphone, comprising:

a first printed circuit board;

a second printed circuit board opposed to the first printed circuit board;

a transducer electrically mounted on the first printed circuit board;

a controlling chip electrically mounted on the second printed circuit board;

a connecting member located between the first and second printed circuit boards, with one end electrically connected to a plurality of first conductive areas on the first printed circuit board, and the other end connected to a plurality of second conductive areas on the second printed circuit board; wherein the connecting member includes a supporting body with through holes, and a plurality of connecting poles passing through the through holes.

2. The silicon based capacitive microphone as described in claim 1, wherein the supporting body defines an opening, and the transducer partially resides in the opening.

3. The silicon based capacitive microphone as described in claim 1, wherein the supporting body defines an opening, and the controlling chip partially resides in the opening.

4. The silicon based capacitive microphone as described in claim 1, wherein the first printed circuit board defines a sound aperture, and the transducer covers the sound aperture.

5. The silicon based capacitive microphone as described in claim 4 further comprising a housing having a first aperture aligned with the sound aperture.

6. A silicon based capacitive microphone comprising:

a housing having a first aperture and a space;

a first printed circuit board received in the space;

a second printed circuit board opposed to the first printed circuit board;

a transducer mounted on the first printed circuit board;

a controlling chip mounted on the second printed circuit board;

a connecting member arranged in the space with one end connected to the first printed circuit board and the other end connected to the second printed circuit board;

wherein the connecting member includes a supporting body and a plurality of connecting poles.

7. The silicon based capacitive microphone as described in claim 6, wherein the first printed circuit board comprises a plurality of first conductive areas and the second printed circuit board comprises a plurality of second conductive areas.

8. The silicon based capacitive microphone as described in claim 6, wherein the supporting body further includes an opening for partially receiving the transducer and the controlling chip.

* * * * *